US009267507B2

(12) United States Patent
Wu

(10) Patent No.: US 9,267,507 B2
(45) Date of Patent: Feb. 23, 2016

(54) BLADE STRUCTURE FOR CENTRIFUGAL FAN

(75) Inventor: Chun-Ming Wu, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 604 days.

(21) Appl. No.: 13/253,748

(22) Filed: Oct. 5, 2011

(65) Prior Publication Data

US 2013/0089425 A1 Apr. 11, 2013

(51) Int. Cl.
*F04D 29/28* (2006.01)
*F04D 25/06* (2006.01)
*F04D 29/30* (2006.01)

(52) U.S. Cl.
CPC ..... *F04D 25/0613* (2013.01); *F04D 29/281* (2013.01); *F04D 29/30* (2013.01)

(58) Field of Classification Search
CPC ..... F04D 17/12; F04D 17/164; F04D 29/282; F04D 29/30
USPC ..... 416/198 A, 200 R, 200 A, 203
See application file for complete search history.

(56) References Cited

U.S. PATENT DOCUMENTS

| | | | | |
|---|---|---|---|---|
| 7,018,171 | B2 * | 3/2006 | Wang et al. | 415/98 |
| 2002/0057965 | A1 * | 5/2002 | Huang et al. | 415/98 |
| 2005/0095132 | A1 * | 5/2005 | Kao et al. | 416/186 R |
| 2009/0035126 | A1 * | 2/2009 | Hwang et al. | 415/119 |
| 2009/0162198 | A1 * | 6/2009 | Ogino et al. | 416/9 |

* cited by examiner

*Primary Examiner* — Igor Kershteyn

(57) ABSTRACT

A blade structure for centrifugal fan includes a hub, a first blade unit, and a second blade unit. The hub includes at least one connection section, to a radially outer end of which an annular body is connected. The annular body has a first side and an opposite second side; and the first and the second blade unit are arranged on and spaced along the first and the second side of the annular body, respectively. By providing the first and the second blade unit around the hub of a centrifugal fan, the air flows and pressure produced by the centrifugal fan can be largely increased at effectively reduced noise.

7 Claims, 8 Drawing Sheets

BLADE STRUCTURE FOR CENTRIFUGAL FAN

FIELD OF THE INVENTION

The present invention relates to a blade structure for centrifugal fan, and more particularly to a blade structure for centrifugal fan that includes two levels of blades arranged around a hub to enable a centrifugal fan to have enhanced air guiding and pressurizing effects as well as effectively reduced noise.

BACKGROUND OF THE INVENTION

With the quickly developed electronic industrial field, the currently available electronic elements have constantly upgraded performance and accordingly, very fast computing speed. As a result, a large amount of heat is generated by the electronic elements during the high-speed operation thereof. The large amount of heat must be timely removed from the electronic elements to protect the electronic elements against lowered operational performance or even burnout. Therefore, a small-size centrifugal fan is usually utilized in the limited space of an electronic product for removing heat therefrom. The centrifugal fan mainly includes a frame, a hub, and a plurality of blades externally spaced along the hub. The frame defines at an upper and a lower side with an air-in opening each, and at one lateral side with an air-out opening. When the centrifugal fan operates, the blades rotate to cause ambient air to flow. Air axially flows into the frame via the upper and lower air-in openings is guided by the blades to flow in a radial direction of the hub and out of the centrifugal fan via the air-out opening. To produce higher air pressure and more air flows, fan manufacturers have made efforts to change the shape of the blades. However, the effects of increased pressure and air flow that can be obtained via modification of blade shapes are limited and fail to satisfy general users' demands. Further, since the centrifugal fan has a relatively small frame, which also limits the possible change of the blades in shape. In brief, the blades for the conventional centrifugal fan have the following disadvantages: (1) being limited in the structural design thereof; (2) providing only limited pressurizing effect; (3) having relatively poor air guiding efficiency; and (4) producing relatively high noise.

SUMMARY OF THE INVENTION

A primary object of the present invention is to provide a blade structure for centrifugal fan that enables a centrifugal fan to have enhanced air guiding and pressurizing effects as well as effectively reduced noise.

To achieve the above and other objects, the blade structure for centrifugal fan according to the present invention includes a hub, a first blade unit, and a second blade unit.

The hub has at least one connection section, to a radially outer end of which an annular body is connected. The annular body has a first side and an opposite second side.

The first blade unit includes a plurality of first blades arranged on and spaced along the first side of the annular body.

The second blade unit includes a plurality of second blades arranged on and spaced along the second side of the annular body.

The first and the second blade unit constitute a bidirectional pressurizing structure for a centrifugal fan to have largely increased air guiding efficiency and enhanced pressurization and noise reduction effects.

In brief, the present invention has the following advantages: (1) enabling increased air flows; (2) providing good air guiding efficiency; (3) enabling increased air pressure; (4) providing good pressurization effect; (5) enabling noise reduction; and (6) allowing customized blade angle design.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
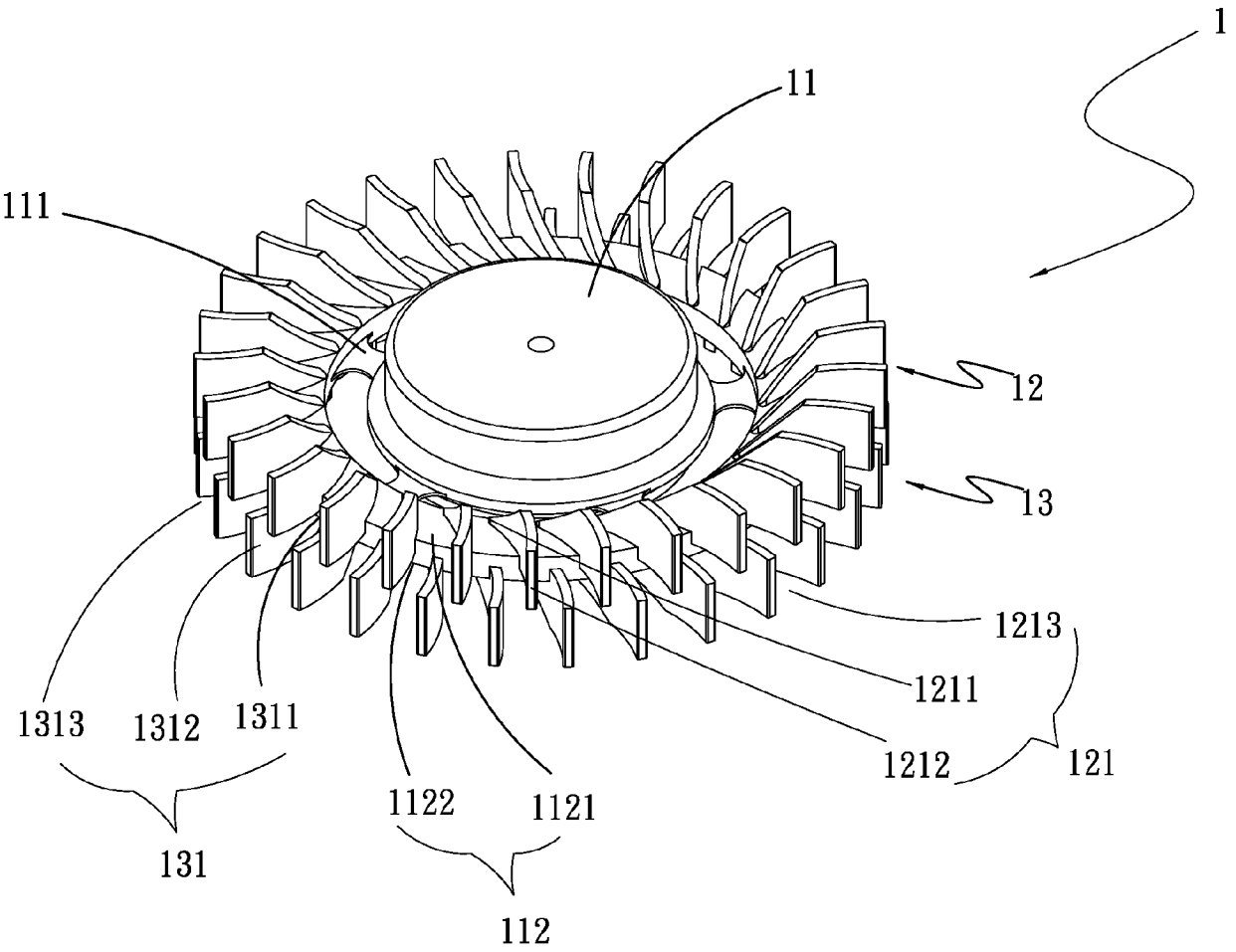
FIG. 1 is a perspective view of a blade structure for centrifugal fan according to a first embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 2:
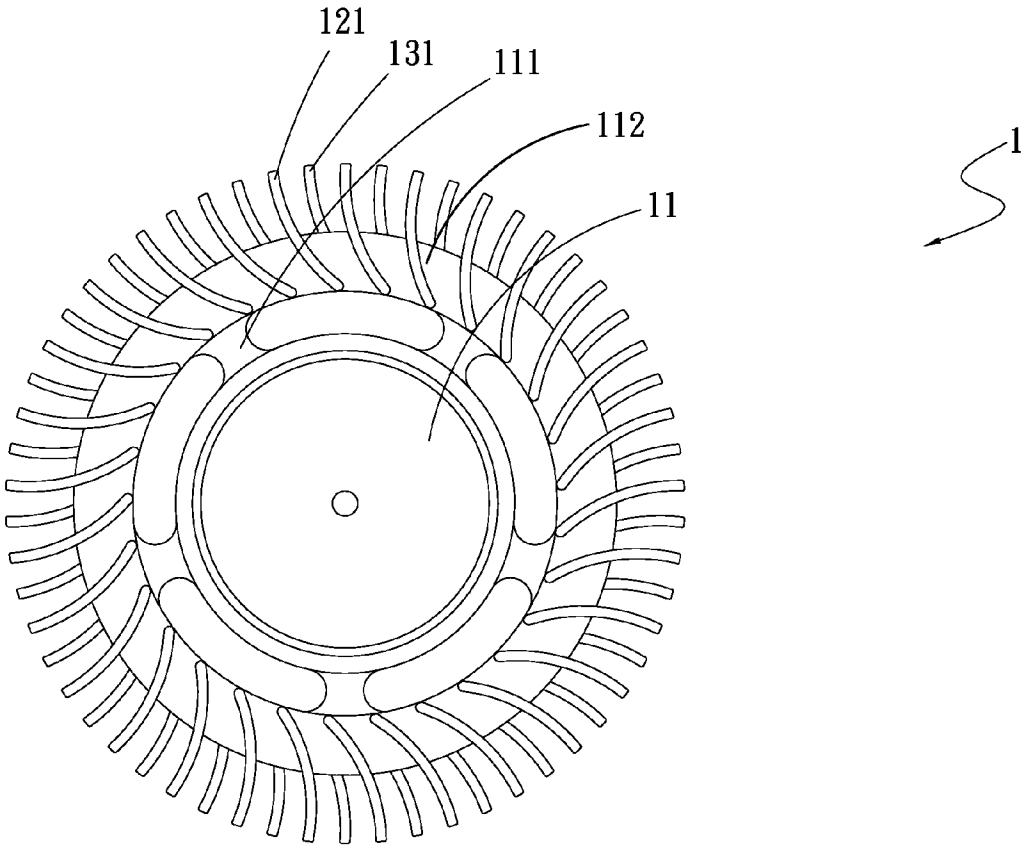
FIG. 2 is a top view of FIG. 1.

Please refer to FIGS. 1 and 2 that are perspective and top views, respectively, of a blade structure for centrifugal fan according to a first embodiment of the present invention. For the purpose of conciseness, the present invention is also briefly referred to as "the blade structure" herein and is generally denoted by reference numeral 1. As shown, in the first embodiment, the blade structure 1 includes a hub 11, a first blade unit 12, and a second blade unit 13.

The hub 11 includes at least one connection section 111, to a radially outer end of which an annular body 112 is connected. The annular body 112 includes a first side 1121 and an opposite second side 1122.

The first blade unit 12 includes a plurality of first blades 121, which are arranged on and spaced along the first side 1121 of the annular body 112.

The second blade unit 13 includes a plurality of second blades 131, which are arranged on and spaced along the second side 1122 of the annular body 112.

Each of the first blades 121 includes a first end 1211 and an opposite second end 1212. Any two adjacent ones of the first blades 121 together define a first flow passage 1213 between them. Each of the second blades 131 includes a third end 1311 and an opposite fourth end 1312. Any two adjacent ones of the second blades 131 together define a second flow passage 1313 between them.

The first and the second side 1121, 1122 are located at an upper and a lower side of the annular body 112, respectively.

Figure 3:
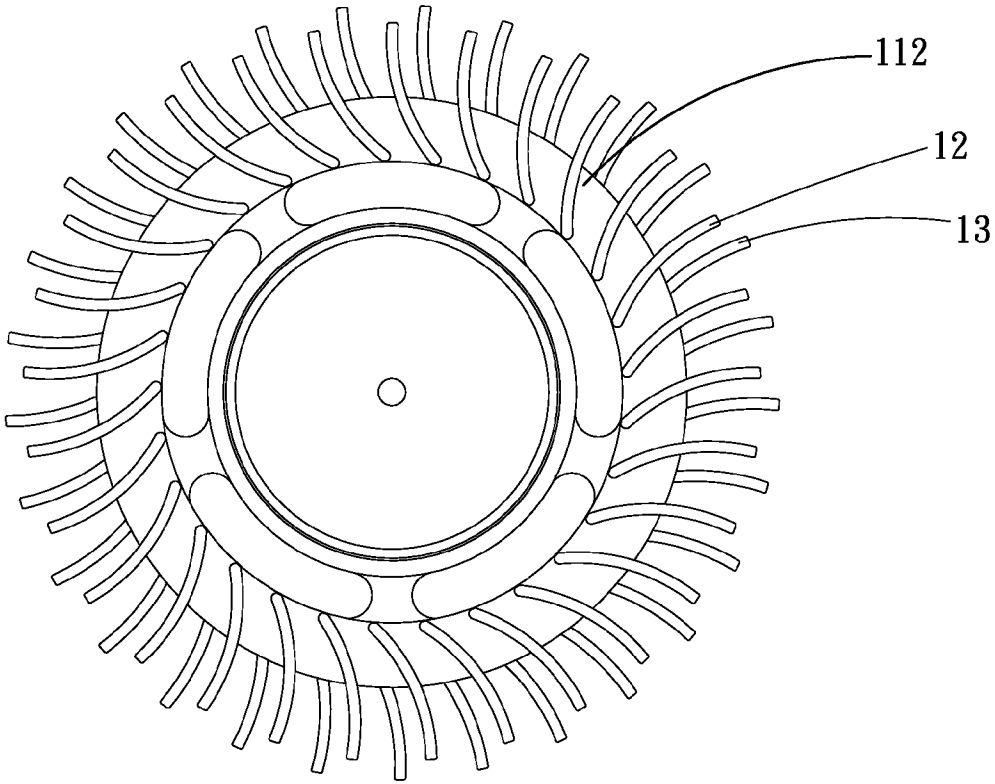
FIG. 3 is a top view of a blade structure for centrifugal fan according to a second embodiment of the present invention.

Please refer to FIG. 3 that is a top view of a blade structure for centrifugal fan according to a second embodiment of the present invention. As shown, the second embodiment is generally structurally similar to the first embodiment, except that a length by which the first blade unit 12 radially outward extends from the annular body 112 is shorter than a length by which the second blade unit 13 radially outward extends from the annular body 112.

Figure 4:
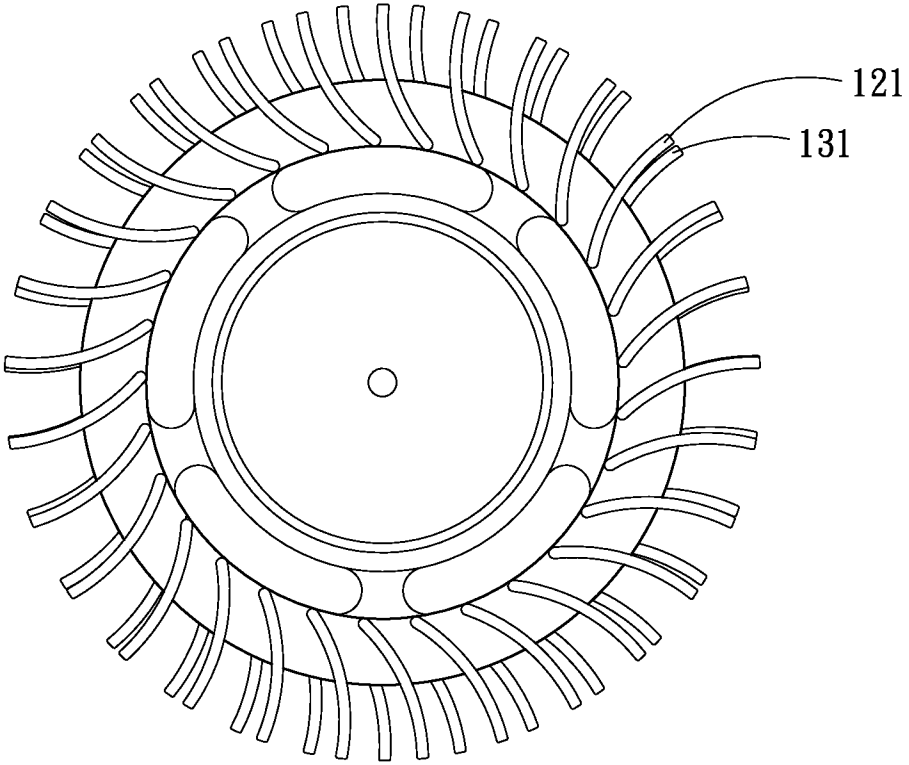
FIG. 4 is a top view of a blade structure for centrifugal fan according to a third embodiment of the present invention.

FIG. 4 is a top view of a blade structure for centrifugal fan according to a third embodiment of the present invention. As shown, the third embodiment is generally structurally similar to the first embodiment, except that the first blades 121 and the second blades 131 are different in number. While the number of the first blades 121 in the illustrated third embodiment is smaller than that of the second blades 131, it is understood the present invention is not necessarily limited thereto and the number of the first blades 121 may be otherwise larger than that of the second blades 131.

Figure 5:
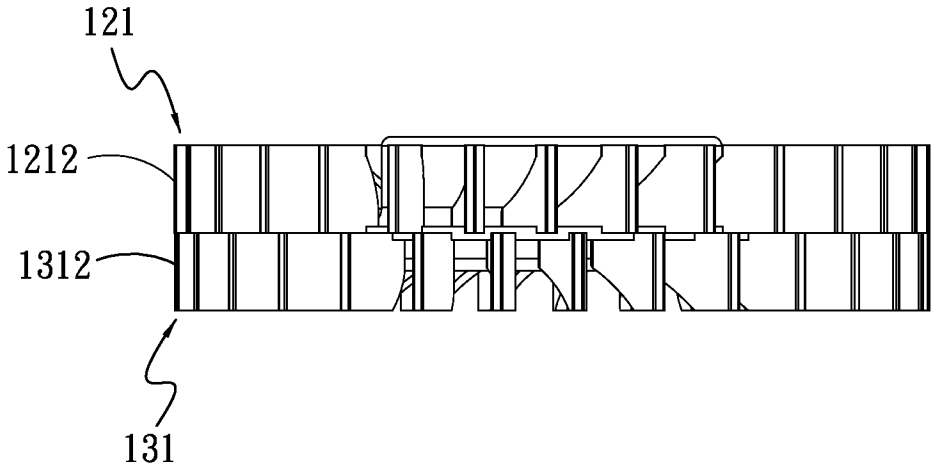
FIG. 5 is a side view of a blade structure for centrifugal fan according to a fourth embodiment of the present invention.

Please refer to FIG. 5 that is a side view of a blade structure for centrifugal fan according to a fourth embodiment of the present invention. As shown, the fourth embodiment is generally structurally similar to the first embodiment, except that a height of the first blades 121 at the second end 1212 thereof is larger than a height of the second blades 131 at the fourth end 1312 thereof.

Figure 6:
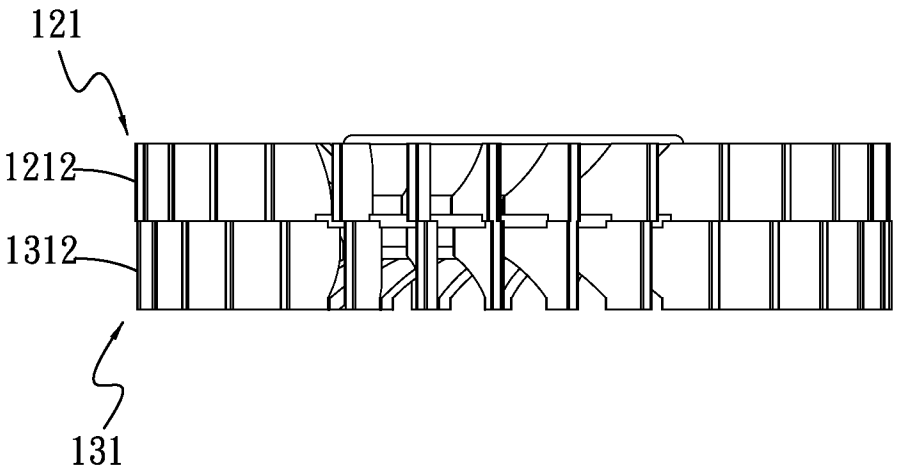
FIG. 6 is a side view of a blade structure for centrifugal fan according to a fifth embodiment of the present invention.

FIG. 6 is a side view of a blade structure for centrifugal fan according to a fifth embodiment of the present invention. As shown, the fifth embodiment is generally structurally similar to the first embodiment, except that a height of the first blades 121 at the second end 1212 thereof is smaller than a height of the second blades 131 at the fourth end 1312 thereof.

Figure 7:
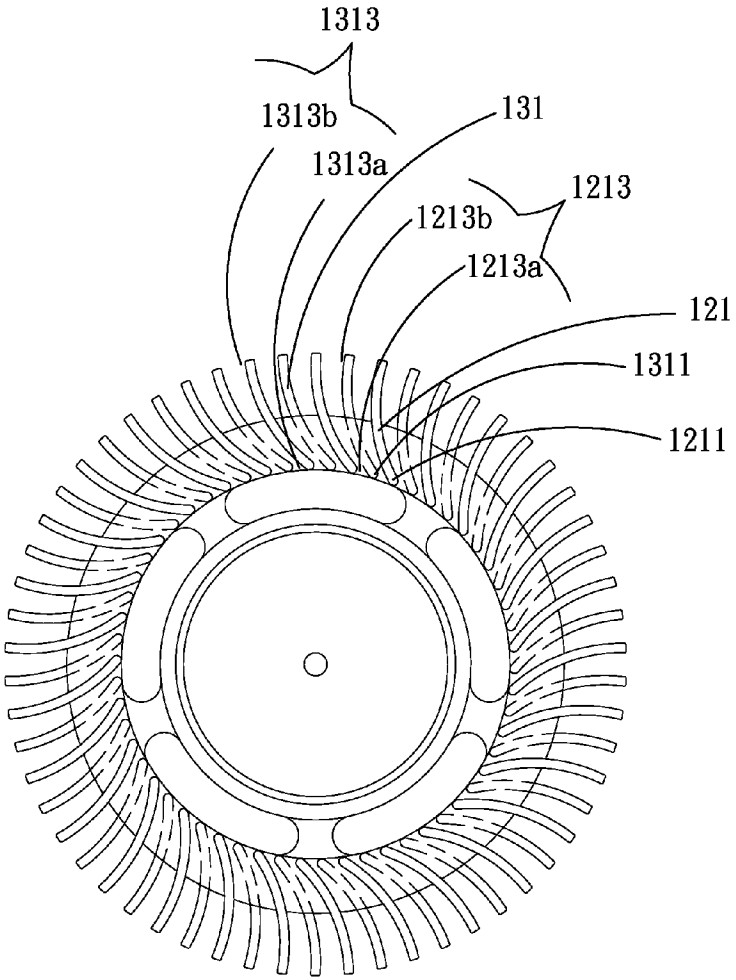
FIG. 7 is a top view of a blade structure for centrifugal fan according to a sixth embodiment of the present invention.

Please refer to FIG. 7 that is a top view of a blade structure for centrifugal fan according to a sixth embodiment of the present invention. As shown, the sixth embodiment is generally structurally similar to the first embodiment, except that the first ends 1211 of the first blades 121 and the third ends 1311 of the second blades 131 are not correspondingly located on the annular body 112 but are arranged along the annular body 112 in staggered relation. More specifically, the first flow passage 1213 defined between any two adjacent first blades 121 has a first air-in end 1213*a* and a first air-out end 1213*b*; and the second flow passage 1313 defined between any two adjacent second blades 131 has a second air-in end 1313*a* and a second air-out end 1313*b*. And, in the sixth embodiment of the present invention, the first air-in ends 1213*a* and the second air-in ends 1313*a* are not correspondingly located on the annular body 112 but are arranged along the annular body 112 in staggered relation.

Figure 8:
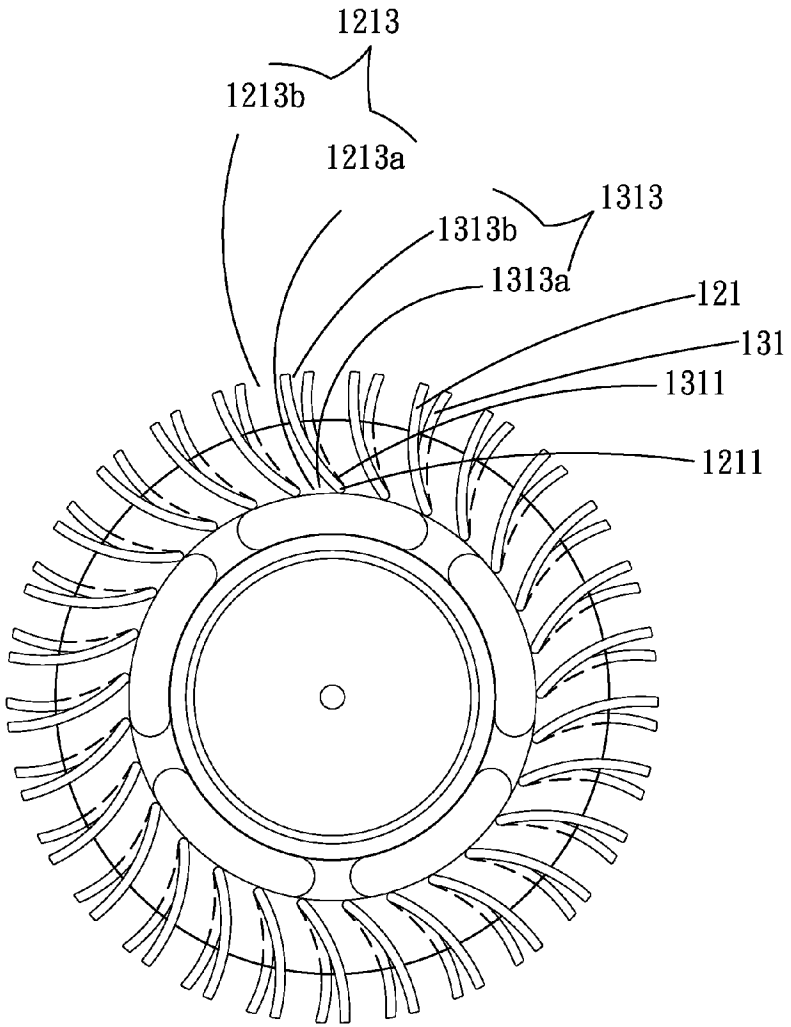
FIG. 8 is a top view of a blade structure for centrifugal fan according to a seventh embodiment of the present invention.

Please refer to FIG. 8 that is a top view of a blade structure for centrifugal fan according to a seventh embodiment of the present invention. As shown, the seventh embodiment is generally structurally similar to the sixth embodiment, except that the first ends 1211 of the first blades 121 and the third ends 1311 of the second blades 131 are correspondingly located on the annular body 112, and accordingly, the first air-in ends 1213*a* and the second air-in ends 1313*a* are correspondingly arranged along the annular body 112.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A blade structure for centrifugal fan, comprising:

a hub including at least one connection section, to a radially outer end of which an annular body is connected; and the annular body including a first side and an opposite second side;

a first blade unit including a plurality of first blades arranged on and spaced along the first side of the annular body; the first blades respectively having a first end and an opposite second end; the first end being a proximal end and corresponding to the hub and further comprising a first recess; the second end being a distal end; a surface of the first blade being gradually increased from the first end to the second end to define the first recess between the first and the second ends; any two adjacent ones of the first blades together defining a first flow passage therebetween; a surface shape between the first end and the first recess being a triangle; and a surface shape between the second end and the first recess being a rectangle and a notch separating the triangle and the rectangle;

a second blade unit mounted in opposed relation to the first blade unit including a plurality of second blades arranged on and spaced along the second side of the annular body; the second blades respectively having a third end and an opposite fourth end; the third end being a proximal end corresponding to the hub and further comprising a second recess; the fourth end being a distal end; a surface of the second blade being gradually increased from the third end to the fourth end to define the second recess between the third and the fourth ends; any two adjacent ones of the second blades together defining a second flow passage therebetween; a surface shape between the third end and the second recess being a triangle; a surface shape between the fourth end and the second recess being a rectangle and a notch separating the triangle and the rectangle;

wherein in said opposed relation the first blades and the second blades define opposed recesses along opposite sides of the annular body;

wherein the first blade unit radially outward extends from the annular body by a length, which is shorter than a length by which the second blade unit radially outward extends from the annular body;

wherein the first and second blades are curved along the length thereof; and wherein the first ends of the first blades and the third ends of the second blades are arranged along the annular body in staggered relation, and the first blades of the first blade unit on the first side of the annular body and the second blades of the second blade unit on the second side of the annular body are arranged in staggered relation.

2. The blade structure for centrifugal fan as claimed in claim 1, wherein the first and the second side of the annular body correspond to an upper and a lower side of the annular body, respectively.

3. The blade structure for centrifugal fan as claimed in claim 1, wherein the first and the second blades are the same in number.

4. The blade structure for centrifugal fan as claimed in claim 1, wherein the first and the second blades are different in number.

5. The blade structure for centrifugal fan as claimed in claim 1, wherein a height of the first blades at the second ends is larger than a height of the second blades at the fourth ends.

6. The blade structure for centrifugal fan as claimed in claim 1, wherein a height of the first blades at the second ends is smaller than a height of the second blades at the fourth ends.

7. The blade structure for centrifugal fan as claimed in claim 1, wherein the first flow passages respectively have a first air-in end and a first air-out end, and the second flow passages respectively have a second air-in end and a second air-out end; and the first air-in ends and the second air-in ends being arranged along the annular body in staggered relation.

* * * * *